United States Patent [19]

Pascal et al.

[11] Patent Number: 4,561,673

[45] Date of Patent: Dec. 31, 1985

[54] SAFETY SKI BINDING

[75] Inventors: Roger Pascal, Annecy-le-Vieux; Rene Bressand, Saint Jorioz, both of France

[73] Assignee: Salomon S.A., Annecy, France

[21] Appl. No.: 560,845

[22] Filed: Dec. 13, 1983

[30] Foreign Application Priority Data

Dec. 13, 1982 [FR] France ..... 82 20852

[51] Int. Cl.[4] ..... A63C 9/085

[52] U.S. Cl. ..... 280/629; 280/636

[58] Field of Search ..... 280/626, 629, 630, 634, 280/636

[56] References Cited

U.S. PATENT DOCUMENTS

| | | | |
|---|---|---|---|
| 4,336,956 | 6/1982 | Richert et al. | 280/629 X |
| 4,398,747 | 8/1983 | Bernard et al. | 280/636 X |
| 4,494,769 | 1/1985 | Beyl et al. | 280/630 |

FOREIGN PATENT DOCUMENTS

| | | |
|---|---|---|
| 754109 | 12/1943 | Fed. Rep. of Germany . |
| 2030749 | 6/1970 | Fed. Rep. of Germany . |
| 2905837 | 8/1980 | Fed. Rep. of Germany . |
| 2948274 | 6/1981 | Fed. Rep. of Germany . |
| 2517214 | 3/1983 | France . |

*Primary Examiner*—Joseph F. Peters, Jr.
*Assistant Examiner*—Michael Mar
*Attorney, Agent, or Firm*—Sandler & Greenblum

[57] ABSTRACT

A safety ski binding having a jaw for holding a boot on a ski and permitting lateral release of the boot, an elastic system for biasing the jaw longitudinally forward against lateral pivoting, and a mechanism for compensating for the additional bias against lateral pivoting arising from friction between the boot and the ski during a forward fall. The compensation means includes a sensor which produces a force on the jaw which opposes the bias of the elastic system, in response to downward movement of the boot. The sensor includes a pedal and a reversing lever. The boot rests on the pedal and the pedal pivots around an axis transverse to the longitudinal axis of the ski when the pedal is pushed downward by the boot. The reversing lever is in contact with the pedal and pivots in the opposite direction from the pedal when the pedal pivots. An anterior arm of the reversing lever rests on a vertical surface of the jaw so that when the reversing lever pivots, the anterior arm exerts a substantially longitudinally rearward force on the jaw which opposes the longitudinally forward bias of the elastic system.

75 Claims, 21 Drawing Figures

SAFETY SKI BINDING

BACKGROUND OF THE INVENTION

1. Field of the Invention

The present invention relates to a safety ski binding adapted to hold and laterally release the front or the rear of the boot, although it is better adapted to retain the front of the boot.

2. Description of the Prior Art

One type of traditional ski binding, called a "stop", holds one end of a ski boot and insures the safety of a skier by permitting lateral pivoting and release of the boot when the skier's leg experiences excessive torsional forces. This pivoting and release of the boot in the lateral direction occurs against the bias of an adjustable elastic locking mechanism which does not permit lateral release until torsional forces on the boot reach a predetermined value. This traditional safety binding, however, has a number of shortcomings which become evident when excessive torsional forces are combined with a forward fall. In the case of a forward fall, the front portion of the bottom of the sole of the boot is pressed against the ski with a large downwardly directed force. As a result, a large frictional force is created between the bottom of the sole and the support surface of the ski. This friction opposes the lateral pivoting and release of the boot.

To eliminate or reduce this friction as much as possible between the front of the sole of the boot and the upper surface of the ski, German Application No. 2,905,837 (published before examination) proposes placing a sensor under the front of the boot to act on the locking mechanism. The locking mechanism bias the boot against lateral release until the threshold value of the locking mechanism is reached. When this threshold valve is exceeded, the boot is laterally released. The sensor comprises a pedal which decreases this threshold of the locking mechanism when the pedal is biased by the front of the boot during a forward fall, to compensate for the friction of the sole on the ski.

All compensation systems of this type, including those described in the above mentioned German patent application, have the disadvantages of being relatively complex in structure, using a large number of elements and having a high cost.

SUMMARY OF THE INVENTION

It is the goal of the present invention to obviate these shortcomings of the prior art by providing a safety binding having a compensation mechanism which has a particularly simple structure and is reliable, regardless of the conditions of use.

To accomplish these goals the safety ski binding of the present invention is provided to maintain and laterally release a boot with respect to a ski. The binding of the present invention comprises a jaw, adapted to laterally retain the end of the boot, an elastic locking mechanism to laterally maintain the jaw, and to bias the jaw against lateral release, and compensation means. The compensation means comprises a sensor which is sensitive to the downward movement of the boot. The sensor decreases the effect of the locking mechanism as a function of the intensity of the downward movement of the boot. As a result, the resistance of the jaw against lateral release is maintained substantially constant.

This sensor comprises a pedal journalled around a transverse axis. The compensation means further comprises an intermediate lever having two arms journalled around a transverse axis. The pedal acts on the first arm and the second arm acts on the jaw, directly or indirectly, so as to exert a force on the jaw which is oriented substantially longitudinally rearward when the pedal experiences a vertical force directed towards the ski during a forward fall of the skier.

In another embodiment of the invention, the binding is designed for maintaining and permitting lateral pivoting and release of a boot with respect to a ski. The binding comprises a jaw, an elastic locking mechanism, and a compensation means. The jaw is adapted to hold one end of the boot and is adapted to laterally pivot and release the boot. The elastic locking mechanism is adapted to bias the jaw against lateral pivoting and release of the boot. The compensation means compensates for bias against lateral pivoting and release of the boot that arises from friction between the boot and the ski which is created during a forward fall. The compensation means comprises a sensor producing a force of the jaw in response to downward motion of the front of the boot during a forward fall. This force reduces the bias of the jaw against the lateral release of the boot.

The magnitude of this force for reducing the bias of the jaw is proportional to the downwardly directed force of the front of the boot on the ski. In addition, the sensor is in contact with the front of the boot and the jaw, and the compensation means comprises a means for maintaining substantially constant resistance of the jaw against lateral pivoting before and during a forward fall.

The sensor comprises a pedal, and a reversing lever. The pedal is adapted to pivot around an axis transverse to the longitudinal axis of the ski in response to downward movement of the front of the boot on the pedal. The reversing lever comprises first and second arms, each of which is adapted to pivot around an axis transverse to the longitudinal axis of the ski. The first and second arms pivot in the opposite direction from the pedal, in response to pivoting of the pedal, wherein the second arm contacts the jaw when pivoting. The second arm produces a force on the jaw when the second arm pivots. This force produced by the second arm on the jaw is oriented substantially longitudinally rearward. In addition, the axis around which the first arm pivots is the same axis as the axis around which the second arm pivots. Furthermore, the binding further comprises a journal pin through which this axis around which the first and second arms pivot passes.

The jaw comprises a substantially vertical face and the second arm acts on this substantially vertical face when the second arm pivots in response to downward movement of the boot on the pedal. The axis around which the pedal pivots is located under the boot when the boot is placed on the pedal. In addition, the pedal comprises a portion adapted to permit the boot to rest thereon when the boot is held by the jaw. The pedal extends upwardly away from the axis around which the pedal pivots, and forwardly toward the jaw. The pedal also comprises an anterior section adapted to act on the first arm in response to pivoting of the pedal.

The sensor is in a rest position when the boot is not held in the binding. In this rest position the first arm of the reversing lever extends upwardly and rearwardly. In addition, the second arm of the reversing lever comprises an end section extending upwardly and comprising an upper end wherein this upper end bears against the jaw. This second arm comprises first and second sections bent at substantially right angles to each other. The first section is a substantially horizontal intermediate section and the second section is an end section. This end section has an upper end and the jaw has a projection extending below the jaw so that this upper end of the second section extends upwardly and bears against this projection. The projection may comprise a vertical cylindrical rod or a nail engaged in the jaw. This rod acts as a means for locking a front support on the binding against movement.

In addition, the binding further comprises a central projection extending downwardly from a lower portion of the jaw at the same vertical level as the rod. This central projection acts as a means for projecting the reversing lever from mud, snow and ice.

The binding also comprises a first base comprising means for holding the pedal. In addition the first base comprises means for ensuring the pedal contacts the first arm of the reversing lever when the boot is not held by the binding. Also, the second arm is so disposed between the first arm and the jaw that the first base further comprises means for ensuring the second arm contacts the jaw when the boot is not held by the binding.

In addition, the binding further comprises a support element including the jaw, and a second base which is adapted to be attached to the ski. In this embodiment, the first base is adapted to be attached to the second base, so that the first base also comprises a means for attaching the pedal to the second base. In addition, the first base may be composed of foil and further comprises a base plate. The base plate is adapted to partially engage under the second base.

The second base comprises at least one opening, as does the base plate. These openings are adapted to receive a screw for attaching the base plate to the second base when the base plate is partially engaged under the second base. This is accomplished by aligning the opening in the base plate with the opening in the second base so that the openings are adapted to receive the screw which firmly attaches the base plate to the second base and maintains the binding on the ski.

In one embodiment, the base plate has a substantially rectangular shape and has a U-shaped right cross section. In addition, the second base has at least one notch therein and the base plate further comprises at least one tab, adapted to engage this notch so as to attach the base plate to the second base.

In another embodiment, the second base comprises two notches and the base plate comprises two opposite sides and two rectilinear tabs. Each rectilinear tab is disposed on a different opposite side of the base plate. Each tab extends toward the other tab and is adapted to engage in one of the notches. In this embodiment, the transverse right cross-section of the base plate taken through these tabs is C-shaped.

In another embodiment, the second base comprises two lateral branches extending rearwardly. Each branch includes one of these above-mentioned notches and the reversing lever is disposed between these two lateral branches of the second base.

In another embodiment, the pedal has a posterior portion with an upper surface and the first base comprises a base plate having a posterior portion with a posterior edge. This posterior edge is bent forwardly over the posterior portion to form a tongue which comprises a spring that is adapted to contact the upper surface of the posterior portion of the pedal. The base plate and the tongue together form a channel having a U-shaped right cross section. The tongue is elastic and extends in the direction of the base plate when the tongue is not deformed. As a consequence, the tongue comprises a return spring for the pedal. This return spring comprises a means for returning the pedal to its rest position after the pedal has been pressed downward by the boot during a forward fall and the boot has been released.

Also provided is a means for preventing the pedal from undergoing substantial forward displacement. In one embodiment, the base plate and pedal together comprise this means for preventing the substantial forward displacement of the pedal when the pedal is mounted on the base plate. In one embodiment, this means for preventing the pedal from substantial forward displacement comprises a longitudinal tab on the base plate which extends upwardly and rearwardly, and in opening the pedal. The tab is adapted to engage this opening in the pedal. In this embodiment, the tab is formed by cutting of the base plate. In another embodiment, the pedal has a lower face and the means for preventing the pedal from substantial forward displacement comprises a projection on the lower face of the pedal and an opening in the base plate. This opening in the base plate is adapted to receive the projection on the pedal.

In still another embodiment, the pedal comprises a friction plate thereon. In addition, the pedal further comprises a posterior section having an upper surface and having a transverse width substantially equal to the first base. The friction plate is disposed on this upper surface of the posterior section. Also provided on the pedal is an anterior section having a transverse width less than the transverse width of the posterior section of the pedal. In this embodiment, the posterior section of the pedal bulges upwardly and the anterior section comprises a lower face having a cavity therein. This cavity is adapted to receive at least a portion of the first arm of the reversing lever. When the pedal is applied flat against this base plate at least a portion of the first arm of the reversing lever is substantially completely engaged and retracted inside this cavity on the lower face of the pedal.

The first arm of the reversing lever, in one embodiment, is a posterior arm and the second arm of the reversing lever is an anterior arm. The arms comprise at least one laterally and vertically extending flange comprising a stiffening element. In another embodiment, these arms comprise two laterally and vertically extending flanges.

In still another embodiment, a journal pin is provided which is disposed between the anterior and posterior arms and around which the anterior and posterior arms are adapted to pivot. In this embodiment the reversing lever has an upper surface and the binding further comprises a covering element for covering at least a portion of this upper surface of the reversing lever. This covering element has an opening therein which is adapted to receive the journal pin in such a manner that the journal pin comprises a means for connecting the reversing lever and the covering element.

The reversing lever can also comprise an intermediate section on the anterior arm, and a junction zone between the intermediate section and the posterior arm. Two spaced apart bridges as provided in this junction zone, which define an opening therebetween. In addition, the covering element further comprises a lower portion having a projection extending therefrom. The opening in the covering element is adapted to engage this projection between the spaced apart bridges.

In one embodiment, these bridges extend downwardly from the junction zone and form an obtuse angle with the junction zone. In addition these bridges are formed by longitudinal cuts in the junction zone. In another embodiment, the reversing lever comprises two laterally and vertically extending flanges extending laterally and vertically from the two arms. The flanges comprise stiffening means, and each flange has a cut-out portion in the shape of an arc having a circumference of more than half of the circle. These cut-out portions are adapted to receive an end of the journal pin when the journal pin is inserted into the opening in the projection and the projection is received in the opening between the bridges. These cut-out portions, therefore, comprise a means for retaining the ends of the journal pin. Alternatively, or in addition, the intermediate section of the anterior arm can comprise the cut-out portions which are also in the shape of an arc having a circumference greater than the length of half a circle. Each of these cut-out portions are adapted to receive an end of the journal pin to insure retention of the end portions of the journal pin.

In another embodiment, the reversing lever and the covering element together form an assembly when the projection engages the opening between the bridges. In this embodiment, the binding further comprises a support element having a jaw and a second base that is adapted to be attached to the ski. The projection has a lower face which includes two notches therein. Each notch is adapted to receive one end of the journal pin. The journal pin is of such a length that each end of the journal pin projects from one of the ends of the assembly when the journal pin is engaged in the opening in the projection, so that each end of the journal pin can be received in one of the notches.

In one embodiment, the covering element has a trapezoidal right cross-section. In this embodiment, the covering element comprises: a central substantially horizontal section; two faces, extended upwardly and outwardly from opposite sides of the central section; two lips each of which extend substantially horizontally outward from one of the two faces; a longitudinally extending face extending longitudinally rearwardly and upward from the central section and connected to the two faces in such a way as to define a partial frustum of a pyramid; a posterior edge; and a downwardly extending lip, extending downwardly from the posterior edge.

In another embodiment, the base plate has an opening therein adapted to receive the projection of the covering element. The projection engages the opening in the base plate under a prestress when the receiving lever is mounted on the second base and on the first base.

In another embodiment, the invention comprises a compensation means for a ski binding. The ski binding has a jaw adapted to hold a boot and an elastic means biasing the jaw against lateral release. The compensation means compensates for friction between the boot and the ski. This compensation means comprises a means for sensing downward motion of the boot, and a transformation means for transforming this downward motion of the boot into a force on the jaw which opposes the bias of the elastic means. The transformation means is activated by the sensing means during a forward fall. All of the elements of the binding and the compensation means in the previous-mentioned embodiments of the safety ski binding are present in this embodiment of the compensation means. In still another embodiment, the invention comprises a method for compensating for friction between a boot held in a binding on a ski, and the ski itself, during a forward fall. The binding comprises a jaw for holding the boot, and an elastic system for biasing the jaw against lateral release of the boot. The method comprises sensing downward movement of the boot during a forward fall by displacing of a sensor, and transforming this displacement of the sensor into pressure on the jaw which opposes bias from the elastic system. The method further comprises maintaining substantially constant resistance of the jaw against lateral release before and during a forward fall.

The sensing step further comprises pivoting of a pedal around an axis transverse to the longitudinal axis of the ski in response to downward movement of the front of the boot during a forward fall. In addition, the transforming step further comprises pivoting of a reversing lever in the opposite direction from the pedal in response to pivoting of the pedal, and applying an anterior arm of the reversing lever against the jaw as the reversing lever pivots.

The method further comprises displacing an upper end of the anterior arm longitudinally rearward against the jaw.

In one embodiment, the jaw comprises a projection having a vertical face extending downwardly from the jaw and the method further comprises displacing the upper end of the anterior arm against the vertical face of the projection. In this embodiment, the method further comprises protecting the reversing lever from snow and ice and mud by providing a central projection extending downwardly from the jaw and over the reversing lever.

The method may also comprise maintaining contact between an anterior end of the pedal and a posterior end of the posterior arm when the boot is not held by the jaw. In addition, the method also comprises maintaining contact between the upper end of the anterior arm and a vertical face of the projection when the boot is not held by the jaw.

These maintaining steps are accomplished by means of a tongue on a base plate. The method further comprises holding the posterior portion of the pedal with the tongue. In addition, the method also comprises preventing forward displacement of the pedal by the insertion of a tab on the base plate into an opening in the pedal.

The method further comprises holding the base plate in a second base of a support element by insertion of two tabs on the base plate into corresponding notches in the base.

In addition, the anterior section of the pedal comprises a cavity on the lower face thereof for receiving a posterior portion of the posterior arm. In this embodiment, the method further comprises receiving the posterior portion of the posterior arm into the cavity and completely retracting the posterior portion of the posterior arm into the cavity during a forward fall.

In an alternative embodiment, the method may also comprise covering at least a portion of the upper surface of the reversing arm with the covering element and pivoting the pedal and the anterior and posterior arms around a journal pin passing through an opening in the covering element.

BRIEF DESCRIPTION OF THE DRAWINGS

Hereafter given by way of nonlimiting example, an embodiment of the present invention is described by referring to the attached drawings in which.

DETAILED DESCRIPTION OF THE PREFERRED EMBODIMENTS

Figure 1:
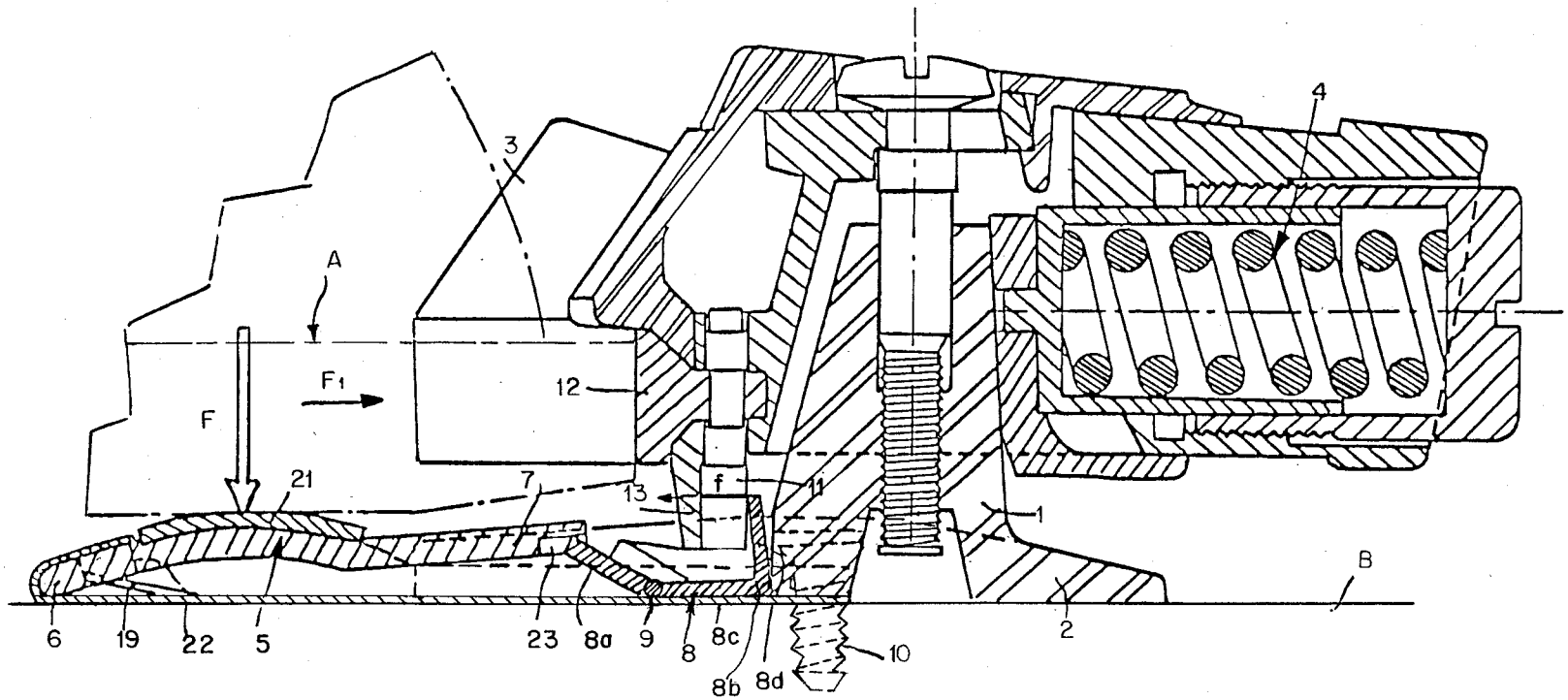
FIG. 1 is a vertical and longitudinal cross-sectional view of a safety binding according to the invention, in the rest position.

The safety binding shown in FIG. 1 comprises a front stop holding the front end of a ski boot A schematically shown by dashed lines. This front stop comprises a support element 1 forming a single element with a base 2 by which it is fixed on the upper surface of a ski B. Support element 1 and base 2 are advantageously molded in a plastic or aluminum single element. On the posterior side of the support element, a jaw 3 is provided which is biased forward by an elastic energization mechanism or elastic locking system 4, so as to be able to rotate, on support element 1, around two parallel or converging support lines. Elastic system 4 also biases jaw 3 against lateral pivoting and release of the boot. Such a forward stop is well known and is described for example, in French patent application No. 81.22577 which is hereby incorporated by reference.

The front stop also comprises compensation means for compensating for the bias against lateral pivoting and release of the boot that arises from friction between the boot and the ski during a forward fall. The compensation means comprises a sensor which reduces the effect of elastic system 4 on jaw 3 in response to downward motion of the front of the boot. Specifically, the sensor produces a force on the jaw which reduces the bias of the jaw against lateral pivoting and release of the boot. The magnitude of this force applied to the jaw is proportional to and a function of the downward motion and force of the front of the boot on the ski. In addition, this force on the jaw, produced by the sensor, that reduces the jaw's resistance to lateral pivoting and release is substantially equal to the frictional force generated by the boot pressing against the ski. This frictional force opposes lateral release and pivoting of the boot during a forward fall. In this way, the compensation means functions to maintain a substantially constant resistance or bias of jaw 3 against lateral pivoting and release of the boot before and during a forward fall.

The sensor comprises a pedal 5 and a reversing lever 8.Pedal 5 extends longitudinally, and is inclined slightly upward and forward, in the rest position, i.e., when the boot is not held in the binding. Pedal 5 is adapted to journal around a transverse axis XX', transverse to the longitudinal axis of the ski. Axis XX' is formed by the end of posterior portion 6 of pedal 5 mounted for rotation in a base 14. Because pedal 5 is adapted to permit the boot to rest thereon, transverse axis XX' is located beneath the boot. Pedal 5 also comprises an anterior portion 7, which is adapted to bear on the end of a posterior arm **8*a* of reversing lever 8**.

Reversing lever 8 comprises two arms—anterior arm **8*b* and posterior arm 8*a*. Lever 8 is adapted to be journalled around a transverse axis $X_1X_1'$ formed by a journal or axis pin 9 located between posterior arm 8*a* and anterior arm 8*b*. Posterior arm 8*a* is normally sloped upward and rearward in the rest position, as shown in FIG. 1. Anterior arm 8*b* comprises two sections bent at substantially right angles to each other. The two sections comprise an intermediate substantially horizontal section 8*c* and an end section 8*d*, extending upward at substantially a right angle to section 8*c***.

Figure 16:
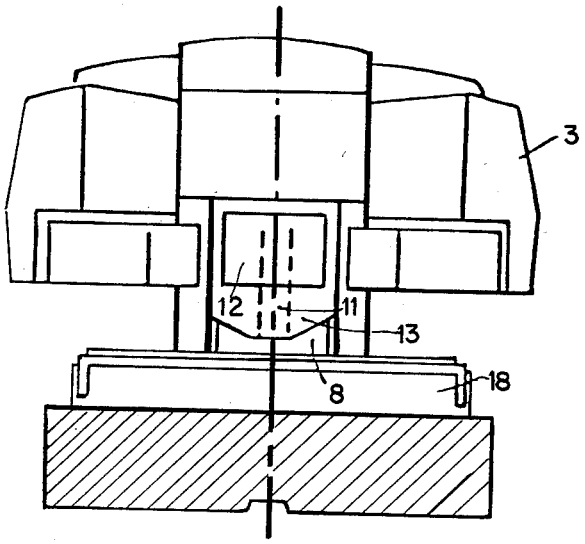
FIG. 16 is a view along arrow F1 of FIG. 1.
Figure 17:
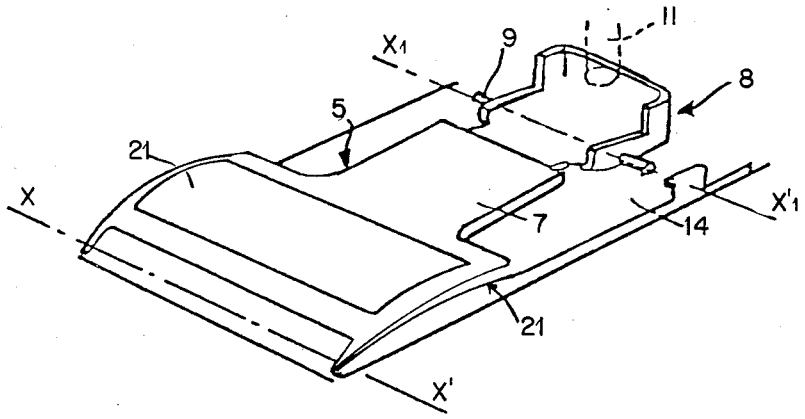
FIG. 17 is a partial perspective view showing the compensation means of the present invention.

The upper end of end section **8*d* of the anterior arm 8*b* rests under jaw 3, at any point thereon. In the embodiment shown in FIG. 1, the upper end of section 8*d* rests against a substantially vertical face of a vertical projection comprising a cylindrical rod or a nail 11 engaged in the jaw. Nail 11 extends vertically downward from jaw 3. The lower part of nail 11 insures the locking of an element 12 against movement. Element 12 comprises a front support for the anterior edge of the sole of ski boot A. In addition, the lower portion of central locking nail 11 bears against a central projection 13 extending downward from jaw 3 and located just behind locking nail 11 at the same vertical level as nail 11. Projection 13 functions to protect lever 8 from snow, mud and ice. In effect, as can be seen in FIG. 16, end section 8*d* of lever 8 is hidden by projection 13**.

Thus it is evident, according to the above description, that when the skier exerts in the case of a forward fall, for example, a vertical force in the direction of the ski with boot A, as it is illustrated by arrow F of FIG. 1, this force is applied to pedal 5 and turns pedal 5 in a clockwise direction around its transverse posterior journal axis XX'. As a result, anterior section 7 bears against posterior arm **8*a* of lever 8 and causes it to pivot around transverse axis pin 9, in a counterclockwise direction. This counterclockwise pivoting of arm 8***a* causes the upper end of end section 8*d* of anterior arm 8*b* to exert, a force f on the vertical face of locking nail 11, and as a result, on the entire jaw 3. This force f is directed substantially horizontally and longitudinally rearward. This rearward directed force f opposes the forward bias of jaw 3 on support 2 produced by elastic system 4, and therefore reduces the force with which jaw 3 is pressed or biased against support element 2. This reduction in the bias jaw 3 against lateral release of the boot is substantially equal to the increased friction between the bottom of the boot and the ski. Consequently, the total bias against lateral pivoting of the jaw remains substantially constant. In other words pedal 5 and reversing lever 8 counteract the spurious friction arising from the pressure exerted by the sole of the boot on the ski, during a safety release. In addition, it should be noted that any downward stress on the ski by the boot, (except the weight of the skier on the boot) will activate the compensation means and reduce the bias of jaw 3 against lateral release to compensate for increased friction of the boot on the ski.

FIGS. 2–15 illustrate one preferred embodiment of the compensation mechanism which transforms the vertical force of the boot on the ski in the direction of arrow F into a longitudinally directed force f on the jaw. This compensation mechanism comprises a base 14 preferably made of a sheet of steel, and for example, in the form of a foil. Base 14 functions to hold pedal 5, and at the same time base 14 functions as as an elastic return mechanism, elastically returning pedal 5 to its rest position seen in FIG. 1 after pedal 5 has been pressed downward against the ski, for example, during a forward fall and release of the boot. In addition, base 14 functions to connect pedal 5 with base 2 of support element 1, as will be explained below.

Figure 2:
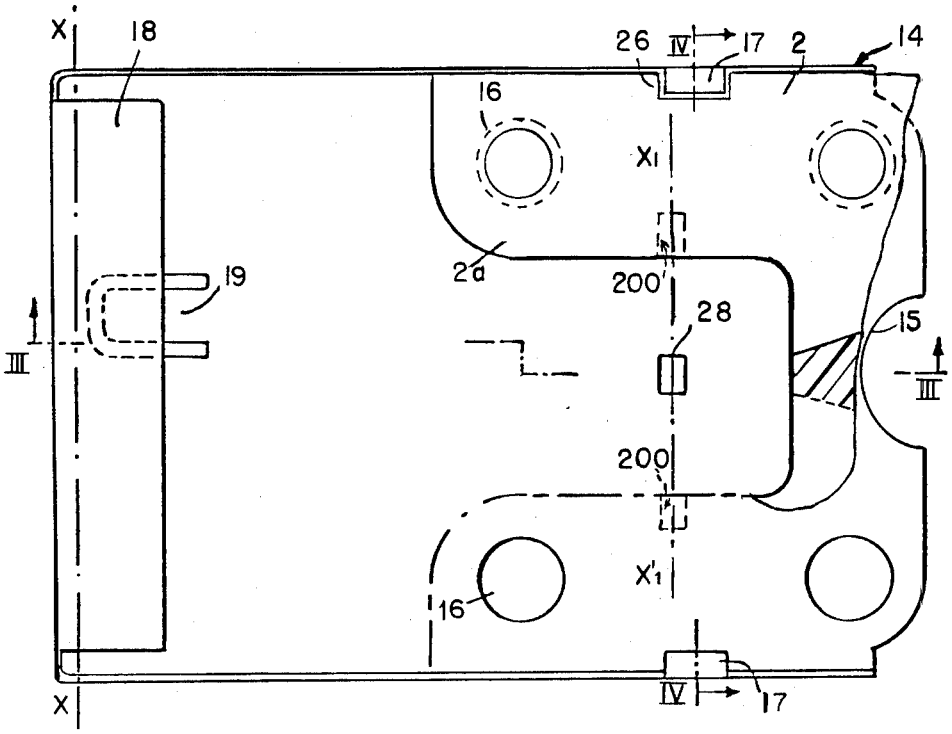
FIG. 2 is a plane view of the base of the compensation mechanism of the present invention.

As seen in FIG. 2, the rear portion of base 2 is U-shaped. The U-shape of the rear portion of base 2 is formed by two lateral branches 2*a* spaced apart in the transverse direction from each other. Lever 8 is mounted between lateral branches 2*a*.

Base 14 comprises a base plate 15 adapted to be partially engaged under base 2 of support element 1. Base plate 15 is pierced with holes 16 which can be aligned with corresponding holes located in base 2. Both holes 16 in base plate 15 and the corresponding holes in base 2 are adapted to receive screws 10 which attach base 15 to ski B and insure the maintenance of the binding on ski B as seen in FIG. 1.

Figure 4:
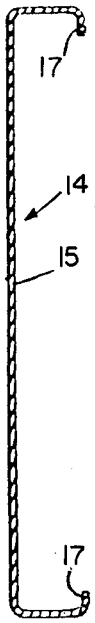
FIG. 4 is a transverse cross-sectional view along line IV—IV of FIG. 3.
Figure 3:
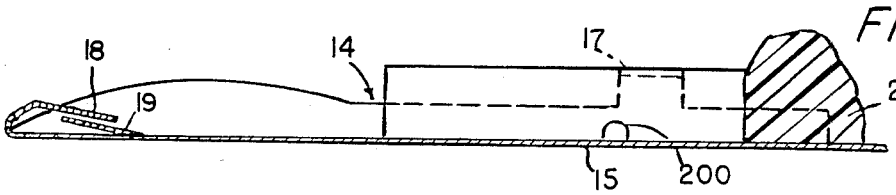
FIG. 3 is a longitudinal cross-sectional view along the line III—III of FIG. 2.

Base plate 15 is substantially rectangular and has a substantially U-shaped right cross-section in one embodiment, as can be seen in FIG. 4. In another embodiment this U-shaped right cross-section is changed to a C-shaped right cross-section when two rectilinear tabs 17, each provided on one longitudinal edge of base plate 15, are folded in the direction of the other tab, and when the right cross-section is viewed in the plane of cross-section IV—IV taken through tabs 17. In an alternate embodiment tabs 17 are square-shaped. Tabs 17 are adapted to engage notches 2*b* provided in the upper face of lateral branches 2*a* of base 2, to insure the connection of base 14 with base 2.

The posterior section of base 14 comprises a tongue 18, which is folded forward from the transverse posterior edge of base 14 to form a channel having a substantially U-shaped right cross-section. In the rest position, i.e., when it is not deformed (for example, when the boot is not held by the binding), elastic tongue 18 is sloped in the direction of base plate 15. Tongue 18 is adapted to bear on the upper, posterior section 6 of pedal 5, as seen in FIG. 1, thereby holding pedal 5. In addition, tongue 18 comprising a spring adapted to bias pedal 5 into the rest position. In addition this spring functions to maintain contact between pedal 5 and posterior section 8*a* of lever 8 and maintain contact between jaw 5 and end section 8*d* of lever 8 when the boot is not held by jaw 3.

Moreover, the binding also comprises a means for preventing pedal 5 from undergoing substantial forward displacement. The means, in one embodiment, comprises a longitudinal tab 19 on base plate 15, formed by cutting plate 15. Tab 19 is preferably rectangular in shape, and preferably extends upwardly and rearwardly. Tab 19 is adapted to engage an opening 22 in pedal 5, to prevent substantially all forward movement of pedal 5 when pedal 5 is mounted on base 14, as can be seen in FIG. 1.

Figure 21:
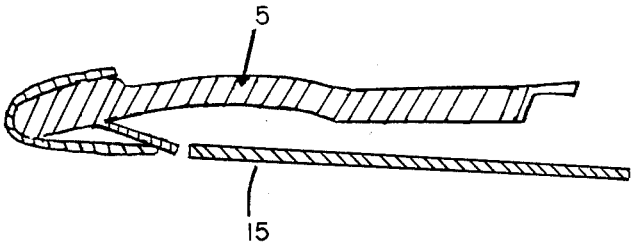
FIG. 21 is a side view of an alternate embodiment of the means of preventing forward displacement of the pedal.

It is within the scope of the invention to provide other means to prevent substantial forward displacement of pedal 5. For example, pedal 5 can have, on its lower face, at least one projection adapted to engage a corresponding opening provided in base plate 15, as seen in FIG. 21.

Figure 5:
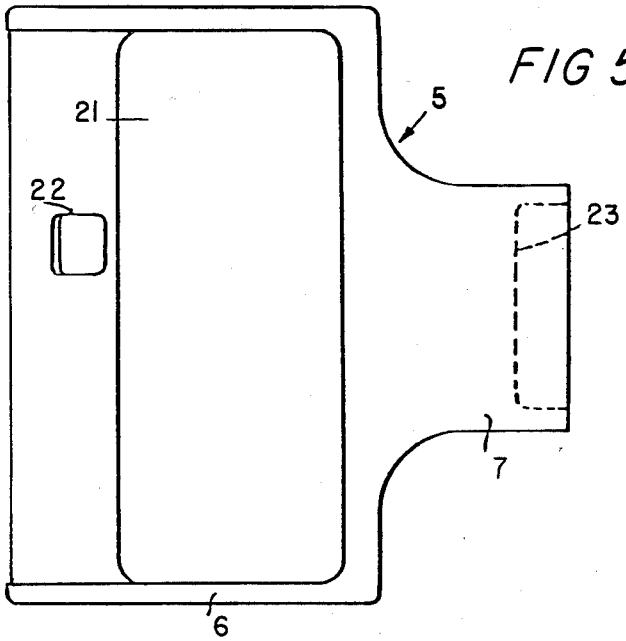
FIG. 5 is a plane view of the pedal of the present invention.
Figure 6:
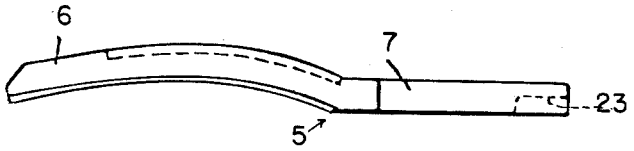
FIG. 6 is a vertical view of the pedal of the present invention.

Pedal 5, which is illustrated in detail in FIGS. 5 and 6, has, preferably, a substantially rectangular shape. Pedal 5 comprises a rectangular, posterior section 6 extending transversely along substantially the entire width of base 14. Posterior section 6 preferably bulges slightly upward, and is engaged between upper elastic tongue 18 and base plate 15. Opening 22 adapted to engaged tab 19 is located in posterior section 6 to prevent all forward displacement of pedal 5. Posterior portion 6 also supports, on its upper surface, a plastic friction plate 21 adapted to contact the boot and composed, for example, of polytetrafluorethylene, which is preferably completely or partially enclosed. In addition, posterior section 6 of pedal 5 is extended in the forward direction by an anterior section 7. Anterior section 7 has a smaller transverse width than posterior section 6. Anterior section 7, comprises, on its lower side, a cavity 23 in which posterior arm 8*a* of lever 8 is adapted to engage. Thus, when pedal 5 is applied flat against base plate 15 (e.g., during a forward fall), posterior arm 8*a* is substantially completely engaged and retracted inside cavity 23, without creating a reinforcement for pedal 5.

Figure 7:
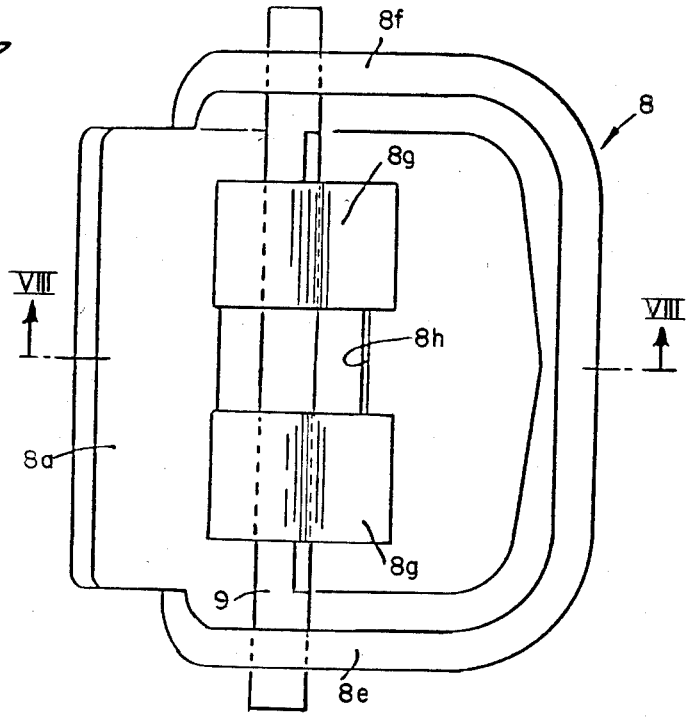
FIG. 7 is a plane view of the reversing lever, having two arms, of the present invention.
Figure 8:
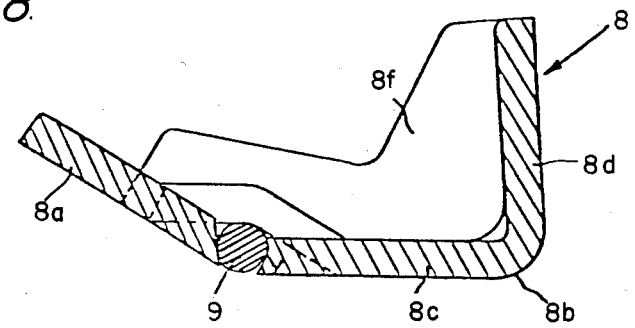
FIG. 8 is a cross-sectional view taken along line VIII—VIII of FIG. 7.
Figure 9:
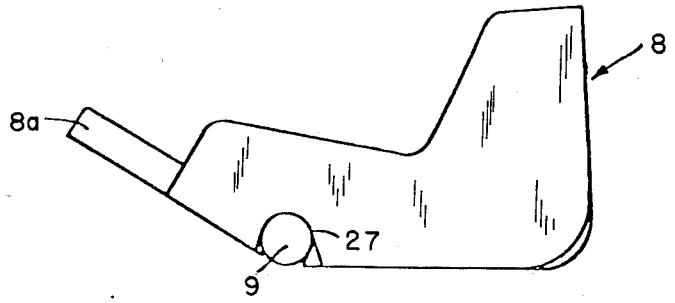
FIG. 9 is a vertical view of the reversing lever of the present invention.
Figure 10:
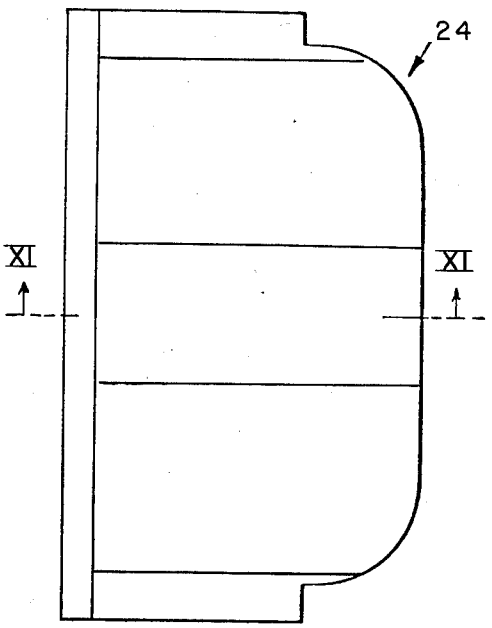
FIG. 10 is a plane view of the covering element of the present invention.
Figure 15:
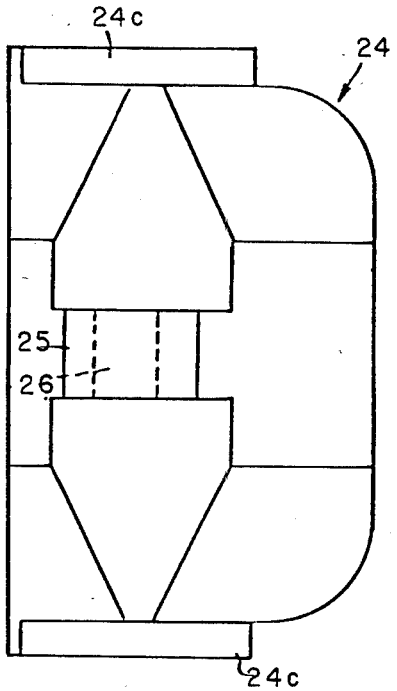
FIG. 15 is a view from below of the covering element of the present invention.

Reversing lever 8 is illustrated in detail in FIGS. 7–9. Lever 8 comprises, preferably, a metal element cut and cambered so as to form posterior arm 8*a* and anterior arm 8*b*. These arms have a predetermined width and are preferably integral with laterally and vertically extending flanges 8*e* and 8*f*. These flanges 8*e* and 8*f* form stiffening elements for lever 8. Lever 8 also comprises a junction zone between posterior arm 8*a* and an intermediate section 8*c* of anterior arm 8*b*. In this junction zone two bridges 8*g* are formed. Each bridge 8*g* extends downwardly from and forms an obtuse angle with the junction zone. Bridges 8*g* are formed by longitudinal cuts in the junction zone of lever 8, and define therebetween a central rectangular opening 8*h* whose purpose will be described hereinbelow.

Lever 8 is capped by a covering element 24 which is shown in FIGS. 10–15. Covering element 24, is preferably made of molded plastic, and has, on its lower portion, a central projection 25. Central projection 25 is pierced so as to form a transverse opening 26 adapted to be traversed by journal axis pin 9 of lever 8. Upper covering element 24 extends the entire width of lever 8 so as to cover the portion of posterior arm 8*a* nearest to axis pin 9 and intermediate section 8*c* of anterior arm 8*b*. Projection 25 is adapted to engage central opening 8*h* of lever 8 in such a manner that opening 26 provided in projection 25 is placed just below bent bridges 8*g*, and is oriented in the transverse direction. To firmly connect covering element 24 and lever 8, projection 25 is engaged in opening 8*h* so that opening 26 is oriented in the transverse direction. Next, axis pin 9 is also oriented transversely and placed under bent bridges 8*g* and inserted into opening 26 of projection 25.

To ensure the retention of the end portions of axis of axis pin 9, cut-out portions 27 are provided in each of the lateral and vertical flanges 8*f* and/or in intermediate section 8*c* as seen in FIG. 9. Cut-outs 27 are preferably in the shape of the arc having a circumference of more than a half-circle.

The length of axis pin 9 is chosen to be greater than the transverse width of lever 8 and covering element 24. As a result, axis pin 9 forms a projection at each end of the assembly formed by lever 8 and covering element 24, when the two elements are assembled together. These projections of axis pin 9 engage notches 200 that are provided on lower face of base 2 of support element 1. Thus, the assembly of lever 8 and covering element 24 are mounted on the ski by axis pin 9 engaging notches 200 of base 2.

Figure 12:
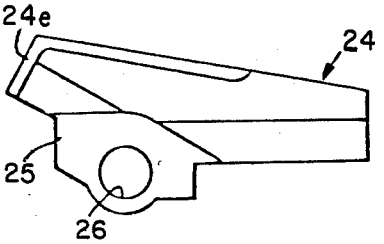
FIG. 12 is a vertical view of the covering element of the present invention.
Figure 13:
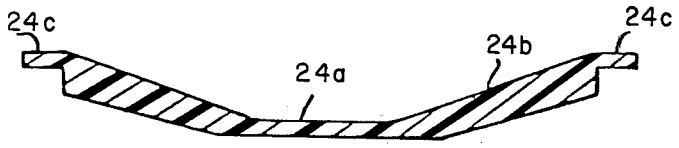
FIG. 13 is a cross-sectional view taken along line XIII—XIII of FIG. 11.
Figure 14:
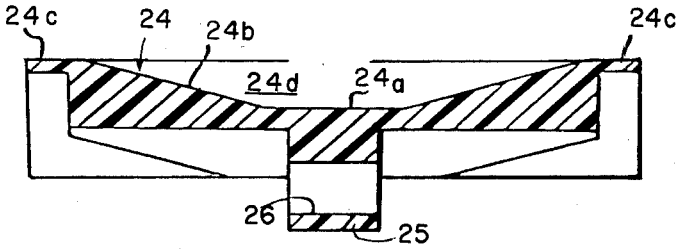
FIG. 14 is a cross-sectional view taken along line XIV—XIV of FIG. 11.

Covering element 24 preferably comprises a trapezoidal right cross-section, as seen in FIGS. 13 and 14. As a result, covering element 24 has, a central substantially horizontal section 24*a*, two faces 24*b* extending upwardly and outwardly from opposite sides of central section 24*a*, and two lips 24*c* each extending substantially horizontally outward, (i.e., parallel to central portion 24*a*) from one of faces 24*b*. In addition, a longitudinally extended sloped face 24*d* is provided, extending longitudinally rearwardly and upwardly from central portion 24*a*. Face 24*d* is attached to sloped lateral faces 24*b* in such a way so as to define a partial frustum of a pyramid. Finally, covering element 24 also comprises, along the length of its posterior edge, a lip 24*e* extending downward, from this posterior edge, as can be seen in FIG. 12.

Figure 11:
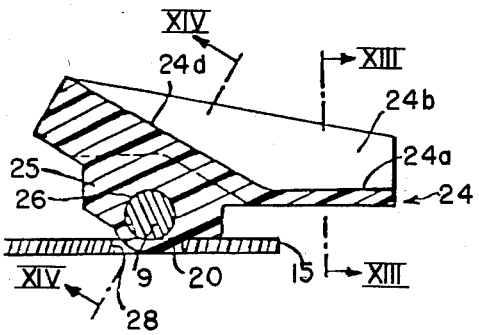
FIG. 11 is a cross-sectional view taken along line XI—XI of FIG. 10.

When lever 8 is mounted on base 2 as described above by pin 9 engaging notches 200 in base 2, lever 8 also contacts base 14. Specifically, projection 25 engages an opening 28 in base plate 15 of base 14 under a slight prestress when the assembly of lever 8 and covering element 24 are attached to base 2, as seen in FIG. 11. Due to this prestress, lever 8 is held firmly in place with respect to base 14.

Figure 18:
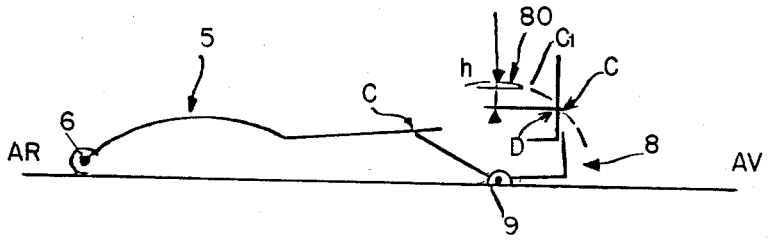
FIG. 18 is a schematic lateral view showing the kinematics of the compensation means of the present invention.

One additional characteristic of the invention is that pivoting axis pin 9 of lever 8 is located behind point C, the point on lever 8 that contacts jaw 3 as seen in FIG. 18. This is particularly advantageous when jaw 3 undergoes upward movement during a lateral release. This occurs in a binding of the type, given by way of nonlimiting example, having converging pivoting axes, as described in French patent Application No. 81 22577 which was previously discussed. In effect, in this type of binding, the jaw pivots around an inclined axis and each point of the jaw is displaced upward at the same time that each point of the jaw is laterally displaced. Because axis pin 9 is behind point C, the trajectory 80 of point C on lever 8 includes point C1. Point C1 is vertically displaced by the amount h with respect to point C, and this vertical displacement of lever 8 is substantially equal to the vertical displacement of an initial point D on jaw 3 which is in contact with lever 8. Thus the relative displacement of points C and D are limited, and therefore, the friction between lever 8 and jaw 3 is limited, which is particularly interesting and advantageous.

Figure 19:
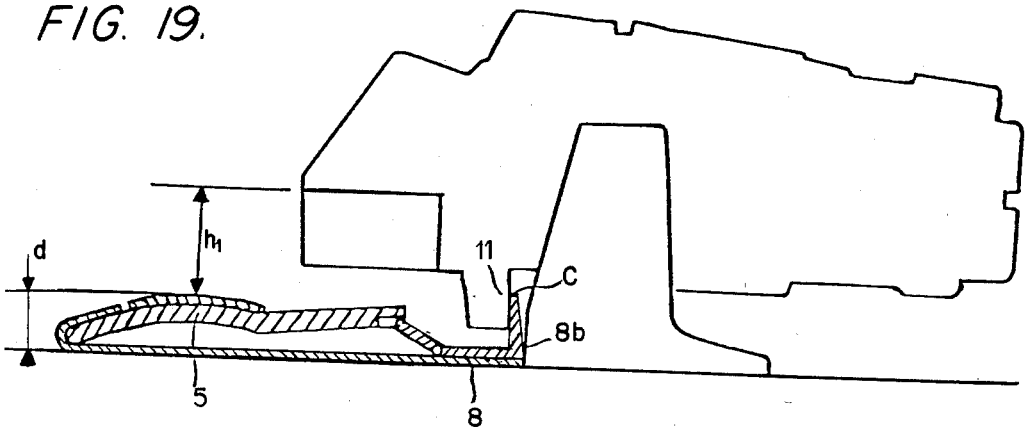
FIGS. 19 and 20 are schematic views showing one of the advantages of the apparatus of the present invention.
Figure 20:
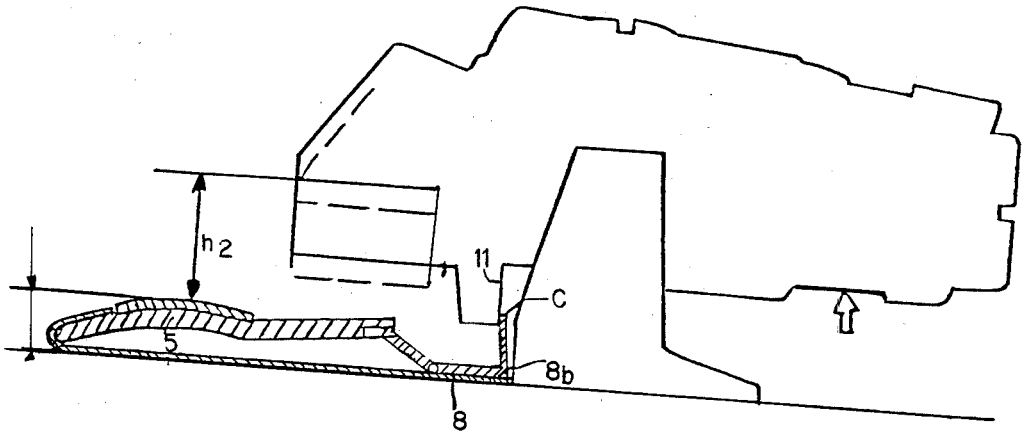

FIGS. 19 and 20 illustrate another advantage of the system, arising from branch 8*b* of lever 8 acting on a substantially vertical face 11 of the jaw. Due to this arrangement, when the height of jaw 3 is adjusted, the height d of pedal 5 remains constant. Therefore, the vertical position, h1 or h2 of jaw 3 does not effect the relative position of the elements comprising the compensation means.

Although the invention has been described with reference to particular materials, means, and configurations, it is to be understood that the invention is not limited to the particulars disclosed, and extends to all alternatives and equivalents within the scope of the claims.

What is claimed is:

1. A safety ski binding for holding a boot on a ski and for permitting lateral release of a boot with respect to a ski, wherein said binding comprises:

(a) a jaw, adapted to hold one end of said boot and adapted to laterally release said boot;

(b) an elastic locking mechanism adapted to bias said jaw against lateral release of said boot; and (c) compensation means for compensating for bias against lateral release of said boot arising from friction between said boot and said ski created during a forward fall, wherein said compensation means comprises a sensor producing a force on said jaw in response to downward movement of the front of said boot during a forward fall, wherein said force reduces said bias of said jaw against lateral release of said boot, wherein said sensor comprises:

(i) a pedal, adapted to pivot around an axis transverse to the longitudinal axis of said ski in response to downward movement of said front of said boot on said pedal; and (ii) a reversing lever, comprising first and second arms each of which is adapted to pivot around an axis transverse to the longitudinal axis of said ski, wherein said first and second arms pivot in the opposite direction from said pedal in response to pivoting of said pedal, wherein said second arm contacts said jaw when pivoting and said first arm contacts said pedal.

2. The binding as defined by claim 1 wherein said sensor is in contact with said front of said boot and said jaw.

3. The binding as defined by claim 2, wherein said compensation means comprises means for maintaining substantially constant resistance of said jaw against lateral release before and during a forward fall.

4. The binding as defined by claim 1 wherein said second arm produces a force on said jaw when said second arm pivots and said force produced by said second arm on said jaw is oriented substantially longitudinally rearward.

5. The binding as defined by claim 4 wherein said axis around which said first arm pivots is the same axis as the axis around which said second arm pivots, and wherein said binding further comprises a journal pin through which said axis around which said first and second arms pivot passes.

6. The binding as defined by claim 5 wherein said jaw comprises a substantially vertical face and said second arm acts on said substantially vertical face when said second arm pivots in response to downward movement of said boot on said pedal.

7. The binding as defined by claim 6 wherein said axis around which said pedal pivots is located under said boot when said boot is placed on said pedal and wherein said pedal comprises a portion adapted to permit said boot to rest thereon when said boot is held by said jaw, and wherein said pedal extends upwardly, away from said axis around which said pedal pivots, and forwardly toward said jaw, and wherein said pedal comprises an anterior section adapted to act on said first arm in response to pivoting of said pedal.

8. The safety ski binding as defined by claim 7 wherein said sensor is in a rest position when said boot is not held by said binding and wherein said first arm of said reversing lever extends upwardly and rearwardly when said sensor is in said rest position, and wherein said second arm comprises an end section extending upward and comprising an upper end wherein said upper end bears against said jaw.

9. The safety ski binding as defined by claim 8 wherein said second arm of said reversing lever comprises first and second sections bent at substantially right angles to each other, wherein said first section is a substantially horizontal intermediate section and said second section is an end section.

10. The safety ski binding as defined by claim 9 wherein said end section has an upper end and said jaw has a projection extending below said jaw, and wherein said upper end of said end section extends upwardly, and bears against said projection.

11. The safety ski binding as defined by claim 10 whefein said projection comprises a vertical cylindrical rod engaged in said jaw.

12. The safety ski binding as defined by claim 11 wherein said binding further comprises a front support for said boot and wherein said rod comprises a means for locking said front support against movement.

13. The safety ski binding as defined by claim 12 wherein said jaw has a lower portion and wherein said binding further comprises a central projection extending downwardly from said lower portion of said jaw at the same vertical level as said rod.

14. The safety ski binding defined by claim 13 wherein said central projection comprises a means for protecting said reversing lever from snow and ice and mud.

15. The safety ski binding as defined by claim 1 further comprising a first base comprising means for holding said pedal.

16. The safety ski binding as defined by claim 15 wherein said first base further comprises means for ensuring said pedal contacts said first arm of said reversing lever when said boot is not held by said binding and wherein second arm is so disposed between said first arm and said jaw that said first base further comprises means for ensuring said second arm contacts said jaw when said boot is not held by said binding.

17. The safety ski binding as defined by claim 16 wherein said binding further comprises:

(d) a support element comprising:

(i) said jaw;

(ii) a second base, adapted to be attached to said ski, wherein said first base is adapted to be attached to said second base, so that said first base comprises means for attaching said pedal to said second base.

18. The safety ski binding as defined by claim 17 wherein said first base further comprises means for elastically returning said pedal to said rest position after said pedal has been pressed downward by said boot during a forward fall and said boot has been released.

19. The safety ski binding as defined by claim 18 wherein said base is composed of foil.

20. The safety ski binding as defined by claim 18 wherein said first base comprises a base plate and said base plate is adapted to be partially engaged under said second base of said support.

21. The safety ski binding as defined by claim 20 wherein said second base comprises at least one opening and said base plate comprises at least one opening, wherein said at least one openings are adapted to receive a screw and wherein, when said base plate is partially engaged under said second base said at least one opening in said base plate is aligned with said at least one opening in said second base so that said openings are adapted to receive said screw, wherein said screw firmly attaches said base plate to said second base and maintains said binding on said ski.

22. The safety binding as defined by claim 21 wherein said base plate has a substantially rectangular shape.

23. The safety binding as defined by claim 21 wherein said base plate has a U-shaped right cross-section.

24. The safety binding as defined by claim 23 wherein said second base has at least one notch therein and said base plate further comprises at least one tab adapted to engage said at least one notch to attach said base plate with said second base.

25. The safety binding as defined by claim 24 wherein said second base comprises two notches and said base plate has two opposite sides and wherein said base plate further comprises two rectilinear tabs, each disposed on a different opposite side of base plate, wherein each tab extends toward said other tab and each tab is adapted to engage one of said notches, wherein the transverse right cross-section of said base plate taken through said tabs is C-shaped.

26. The safety ski binding as defined by claim 25 wherein said second base comprises two lateral branches extending rearwardly, wherein each branch includes one of said notches, and wherein said reversing lever is disposed between said two lateral branches.

27. The safety ski binding defined by claim 15 wherein said pedal has a posterior portion with an upper surface, and said first base comprises a base plate having a posterior portion with a posterior edge, wherein said posterior edge is bent forwardly over said posterior portion so as to form a tongue adapted to contact said upper surface of said posterior portion of said pedal, wherein said base plate and said tongue together form a channel having a U-shaped right cross-section, and wherein said tongue is elastic and wherein said tongue extends in the direction of said base plate when said tongue is not deformed, and wherein said tongue comprises a return spring for said pedal.

28. The safety ski binding defined by claim 27 wherein said return spring comprises a means for returning said pedal to said rest position after said pedal has been pressed downward by said boot during a forward fall and said boot has been released.

29. The safety ski binding as defined by claim 28 wherein said binding further comprising means for preventing said pedal from undergoing substantial forward displacement.

30. The safety ski binding as defined by claim 29 wherein said base plate and said pedal together comprise said means for preventing said pedal from undergoing substantial forward displacement when said pedal is mounted in said base plate.

31. The safety ski binding as defined by claim 30 wherein said means for preventing said pedal from undergoing substantial forward displacement comprises:

a longitudinal tab on said base plate and extending upwardly and rearwardly; and an opening in said pedal, wherein said tab is adapted to engage said opening.

32. The safety ski binding as defined by claim 31 wherein said tab is formed by cutting of said base plate.

33. The safety ski binding as defined by claim 30 wherein said pedal has a lower face and said means for preventing said pedal from undergoing substantial forward displacement comprises:

a projection on said lower face of said pedal; and an opening on said base plate, adapted to receive said projection.

34. The safety ski binding as defined by claim 16 wherein said pedal comprises a friction plate thereon.

35. The safety ski binding as defined by claim 34 wherein said pedal further comprises:

a posterior section having an upper surface and having a transverse width substantially equal to said first base and wherein said friction plate is disposed on said upper surface of said posterior section; and an anterior section having a transverse width less than the transverse width of said posterior section.

36. The safety ski binding as defined by claim 35 wherein said posterior section of said pedal bulges upward.

37. The safety ski binding as defined by claim 36 wherein said anterior section comprises a lower face having a cavity thereon, wherein said cavity is adapted to receive at least a portion of said first arm of said reversing lever.

38. The safety ski binding as defined by claim 37 wherein said first base comprises a base plate and wherein, when said pedal is applied flat against said base plate, at least a portion of said first arm is substantially completely engaged and retracted inside said cavity.

39. The safety ski binding as defined by claim 1 wherein said first arm is a posterior arm and said second arm is an anterior arm and wherein said arms comprise at least one laterally and vertically extending flange comprising a stiffening element.

40. The safety ski binding as defined by claim 39 wherein said arms comprise two laterally and vertically extending flanges.

41. The safety ski binding as defined by claim 1 wherein said first arm is a posterior arm and said second arm is an anterior arm and wherein said binding further comprises a journal pin disposed between said anterior and posterior arms and around which said anterior and posterior arms are adapted to pivot.

42. The safety ski binding defined by claim 41 wherein said reversing lever has an upper surface and wherein said binding further comprises a covering element for covering at least a portion of said upper surface of said reversing lever and having an opening therein adapted to receive said journal pin in such a manner that said journal pin comprises a means for connecting said reversing lever and said covering element.

43. The safety ski binding defined by claim 42 wherein said reversing lever further comprises:

an intermediate section on said anterior arm;

a junction zone between said intermediate section and said posterior arm; and two spaced apart bridges in said junction zone and defining an opening therebetween, wherein said covering element further comprises a lower portion having a projection extending therefrom, wherein said opening in said covering element is in said projection, and said projection is adapted to engage said opening between said spaced apart bridges.

44. The safety ski binding as defined by claim 43 wherein said bridges extend downward from said junction zone and form an obtuse angle with said junction zone, and wherein said bridges are formed by longitudinal cuts in said junction zone.

45. The safety ski binding as defined by claim 44 wherein said reversing lever further comprises two flanges extending laterally and vertically from said arms, wherein said flanges comprise stiffening means, and wherein each flange comprises a cut-out portion in the shape of an arc having a circumference of more than a half-circle, wherein said cut-out portion is adapted to receive an end of said journal pin, when said journal pin is inserted into said opening in said projection and said projection is received in said opening between said bridges, and wherein said cut-out portions comprise a means for retaining the end of said journal pin.

46. The safety ski binding as defined by claim 44 wherein said intermediate section of said anterior arm comprises a cut-out portion in the shape of an arc having a circumference of greater length than a half-circle, wherein each cut-out portion is adapted to receive an end of said journal pin to insure retention of the end portions of said journal pin.

47. The safety ski binding as defined by claim 43 wherein said reversing lever and said covering element form an assembly when said projection engages said opening between said bridges and wherein said binding further comprises:

(d) a support element, comprising:

(i) said jaw;

(ii) a base, adapted to be attached to said ski, and including a lower face having two notches therein, each notch adapted to receive one end of said journal pin, wherein said assembly has two ends and said journal pin is of such a length that each end of said journal pin projects from one of said ends of said assembly when said journal pin is engaged in said opening in said projection, so that each end of said journal pin can be received in one of said notches.

48. The safety ski binding as defined by claim 43 wherein said covering element has a trapezoidal right cross-section.

49. The safety ski binding as defined by claim 48 wherein said covering element comprises:

(i) a central substantially horizontal section;

(ii) two faces, extending upwardly and outwardly from opposite ends of said central section;

(iii) two lips, each of which extends substantially horizontally outward from one of said two faces;

(iv) a longitudinally extending face, extending longitudinally rearward and upward from said central section and connected to said two faces in such a way as to define a partial frustum of a pyramid;

(v) a posterior edge; and (vi) a downwardly extending lip, extending downwardly from said posterior edge.

50. The safety ski binding as defined by claim 43 wherein said binding further comprises a first base comprising a base plate adapted to hold said pedal and having an opening therein adapted to receive said projection, wherein said binding further comprises a support element comprising:

said jaw; and a second base, adapted to be attached to said ski and on which said reversing lever is adapted to be mounted, wherein said projection engages said opening in said base plate under a prestress when said reversing lever is mounted on said second base and on said first base.

51. The compensation means as defined by claim 1 wherein said second arm produces a force on said jaw when said second arm pivots and said force produced by said second arm on said jaw is oriented substantially longitudinally rearward.

52. The compensation means as define by claim 51 wherein said axis around which said first arm pivots is the same axis as the axis around which said second arm pivots, and wherein said binding further comprises a journal pin through which said axis around which said first and second arms pivot passes.

53. The compensation means as defined by claim 52 wherein said jaw comprises a substantially vertical face and said second arm acts on said substantially vertical face when said second arm pivots in response to downward movement of said boot on said pedal.

54. The compensation means as defined by claim 53 wherein said axis around which said pedal pivots is located under said boot when said boot rests on said pedal and wherein said pedal comprises a portion adapted to permit said boot to rest thereon when said boot is held by said binding, and wherein said pedal extends upwardly, away from said axis around which said pedal pivots, and forwardly toward said jaw, and wherein said pedal comprises an anterior section adapted to act on said first arm in response to pivoting of said pedal.

55. The compensation means as defined by claim 54 wherein said sensor is in a rest position when said boot is not held by said binding, and wherein said first arm extends upwardly and rearwardly when said sensor is in said rest position, and wherein said second arm comprises an end section extending upward and comprising an upper end wherein said upper end bears against said jaw.

56. The compensation means as defined by claim 55 wherein said second arm comprises first and second sections bent substantially at right angles to each other, wherein said first section is a substantially horizontal intermediate section and said second section is an end section.

57. The compensation means as defined by claim 56 wherein said end section has an upper end and said jaw has a projection extending below said jaw, and wherein said upper end of said end section extends upwardly, and bears against said projection.

58. The compensation means as defined by claim 54 further comprising a first base comprising means for holding said pedal.

59. The compensation means as defined by claim 58 wherein said first base further comprises means for ensuring said pedal contacts said first arm when said boot is not held by said binding, and wherein said first base also comprises means for ensuring said second arm contacts said jaw when said boot is not held by said binding.

60. The compensation means as defined by claim 59 wherein said binding further comprises a second base, attached to said ski, wherein said first base is adapted to be attached to said second base so that said first base comprises means for attaching said pedal to said second base.

61. The compensation means as defined by claim 60 wherein said first base further comprises means for elastically returning said pedal to a rest position after said pedal has been pressed downward by said boot during a forward fall and said boot has been released.

62. The compensation means as defined by claim 61 wherein said reversing lever has an upper surface and two spaced apart bridges having an opening therebetween and said binding further comprises a covering element for covering at least a portion of said upper surface of said reversing lever, and having a projection thereon with an opening therein adapted to receive said journal pin, wherein said projection is adapted to be received in said opening between said bridges, and wherein said binding further comprises a second base having two spaced apart notches, each adapted to receive one end of said journal pin when said pin is inserted into said opening in said projection and when said projection is inserted into said opening between said bridges.

63. A compensation means for a ski binding having a jaw adapted to hold a boot on a ski and an elastic means for biasing the jaw against lateral release, for compensating for friction between the boot and the ski, comprising:

(a) means for sensing downward motion of said boot; and (b) transformation means for transforming said downward motion of said boot into a force on said jaw opposing said bias of said elastic means, wherein said transformation means is activated by said sensing means during a forward fall wherein said sensing means comprises a pedal adapted to pivot around an axis transverse to the longitudinal axis of said ski in response to downward movement of said front of said boot on said pedal, wherein said transformation means comprises a reversing lever, comprising first and second arms each of which is adapted to pivot around an axis transverse to the longitudinal axis of said ski, wherein said first arm of said reversing lever is adapted to contact said pedal, wherein said first and second arms pivot in the opposite direction from said pedal in response to pivoting of said pedal against said first arm.

64. The compensation means as defined by claim 63 wherein said compensation means comprises means for maintaining substantially constant resistance of said jaw against lateral pivoting.

65. A method of compensating for friction between a boot held in a binding on a ski, and the ski during a forward fall, wherein the binding comprises a jaw for holding the boot and an elastic system for biasing the jaw against lateral release of the boot, wherein the method comprises:

(a) sensing downward movement of said boot during a forward fall by displacement of a sensor; and (b) transforming said displacement of said sensor into pressure on said jaw opposing said bias from said elastic system, wherein step (a) comprises:

pivoting of a pedal around an axis transverse to the longitudinal axis of said ski in response to downward movement of the front of said boot during a forward fall; and wherein step (b) comprises:

pivoting of a reversing lever in the opposite direction from said pedal in response to pivoting of said pedal wherein said pedal contacts a posterior arm of said reversing lever as said pedal pivots; and applying an anterior arm of said reversing lever against said jaw as said reversing lever pivots.

66. The method as defined by claim 65 wherein said method further comprises:

(c) maintaining substantially constant resistance of said jaw against lateral release before and during a forward fall.

67. The method as defined by claim 65 wherein said anterior arm of said reversing lever has an upper end and wherein said method further comprises:

displacing of said upper end longitudinally rearward against said jaw.

68. The method as defined by claim 67 wherein said jaw comprises a projection having a vertical face extending downwardly from said jaw and wherein said method further comprises displacing said upper end against said vertical face of said projection.

69. The method as defined by claim 68 wherein said method further comprises protecting said reversing lever from snow and ice and mud by providing a central projection extending downwardly from said jaw and over said reversing lever.

70. The method as defined by claim 68 wherein said method further comprises:

maintaining contact between an anterior arm of said pedal and a posterior end of a posterior arm of said reversing lever when said boot is not held by said jaw; and maintaining contact between said upper end of said anterior arm and said vertical face of said projection when said boot is not held by said jaw.

71. The method as defined by claim 70 wherein said method further comprises holding said posterior portion of said pedal with a tongue of a base plate wherein said tongue comprises means for maintaining contact between said anterior arm of said pedal and said posterior end of said reversing lever, and means for maintaining contact between said upper end of said anterior arm and said vertical face of said projection.

72. The method as defined by claim 71 wherein said method further comprises preventing substantial forward displacement of said pedal.

73. The method as defined by claim 72 wherein said method further comprises holding said base plate in a second base of a support element.

74. The method as defined by claim 73 wherein said anterior section of said pedal comprises a cavity in the lower face thereof for receiving a posterior portion of said posterior arm, wherein said method further comprises receiving said posterior portion of said posterior arm into said cavity; and completely retracting said posterior portion of said posterior arm into said cavity during a foward fall.

75. The method as defined by claim 74 wherein said method further comprises:

covering at least a portion of the upper surface of said reversing lever with a covering element; and pivoting said reversing lever around a journal pin passing through an opening in said covering element.

* * * * *